US009824661B2

(12) United States Patent
Kim et al.

(10) Patent No.: US 9,824,661 B2
(45) Date of Patent: Nov. 21, 2017

(54) DISPLAY APPARATUS HAVING REDUCED VERTICAL FLICKERING LINES

(71) Applicant: SAMSUNG DISPLAY CO., LTD., Yongin-si (KR)

(72) Inventors: Sung-Man Kim, Seoul (KR); Hong-Woo Lee, Cheonan-si (KR); Jong-Hwan Lee, Anyang-si (KR); Hyeon-Hwan Kim, Asan-si (KR); Jong-Hyuk Lee, Seoul (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 15/195,263

(22) Filed: Jun. 28, 2016

(65) Prior Publication Data

US 2016/0322016 A1 Nov. 3, 2016

Related U.S. Application Data

(63) Continuation of application No. 12/604,692, filed on Oct. 23, 2009, now Pat. No. 9,401,118.

(30) Foreign Application Priority Data

Dec. 24, 2008 (KR) ..... 10-2008-0133620

(51) Int. Cl.
*G09G 3/36* (2006.01)

(52) U.S. Cl.
CPC ..... *G09G 3/3688* (2013.01); *G09G 3/3614* (2013.01); *G09G 3/3648* (2013.01);
(Continued)

(58) Field of Classification Search
USPC ..... 345/87, 88, 103, 690, 694–696; 349/84, 349/149
See application file for complete search history.

(56) References Cited

U.S. PATENT DOCUMENTS 6,300,977 B1 10/2001 Waechter et al.
7,714,970 B2 5/2010 Kim et al.
(Continued)

FOREIGN PATENT DOCUMENTS

KR 1020060070336 6/2006
KR 1020070047439 5/2007
KR 1020070075584 7/2007

OTHER PUBLICATIONS

Korean Notice of Allowance—Korean patent divisional application No. 10-2014-0182400, dated Feb. 3, 2015, citing KR10-KR2006-0070336 and KR10-2007-0047439.
(Continued)

*Primary Examiner* — Ram Mistry
(74) *Attorney, Agent, or Firm* — Cantor Colburn LLP

(57) ABSTRACT

A display apparatus includes: a plurality of pixel blocks, each pixel block of the plurality of pixel blocks including a first pixel electrode connected to a first switching element and a second pixel electrode connected to a second switching element; gate lines which extend along a first direction and include a first gate line connected to the first switching element and a second gate line connected to the second switching element; and data lines which extend along a second direction intersecting the first direction. A gate voltage is applied to the first gate line before the second gate line, and the first pixel electrode of each of the pixel blocks displays a same color.

12 Claims, 8 Drawing Sheets

(52) U.S. Cl.
CPC ..... *G09G 3/3677* (2013.01); *G09G 3/3696* (2013.01); *G09G 2300/0426* (2013.01); *G09G 2300/0443* (2013.01); *G09G 2300/0465* (2013.01); *G09G 2300/0809* (2013.01); *G09G 2310/0202* (2013.01); *G09G 2320/0233* (2013.01); *G09G 2320/0247* (2013.01); *G09G 2320/0666* (2013.01)

(56) References Cited

U.S. PATENT DOCUMENTS

| | | | | |
|---|---|---|---|---|
| 2006/0120160 | A1* | 6/2006 | Park | G02F 1/1368 365/185.22 |
| 2006/0125755 | A1 | 6/2006 | Noguchi et al. | |
| 2008/0079678 | A1* | 4/2008 | Cho | G09G 3/3648 345/88 |

OTHER PUBLICATIONS

Korean Office Action—Korean patent application No. 10-2008-0133620 dated Feb. 3, 2015, citing 10-2006-0070336.

* cited by examiner

DISPLAY APPARATUS HAVING REDUCED VERTICAL FLICKERING LINES

This application is a continuation of U.S. patent application Ser. No. 12/604,692, filed on Oct. 23, 2009, which claims priority to Korean Patent Application No. 10-2008-0133620, filed on Dec. 24, 2008, and all the benefits accruing therefrom under 35 U.S.C. §119, the content of which in its entirety is herein incorporated by reference.

BACKGROUND OF THE INVENTION

1. Field of the Invention

The present invention relates to a display apparatus and, more particularly, the present invention relates to a liquid crystal display apparatus with substantially improved display quality.

2. Description of the Related Art

Liquid crystal displays ("LCDs") are a widely used type of flat panel displays. Generally, LCDs include substrates having electric field generating electrodes, such as a pixel electrode and a common electrode, disposed thereon, and a liquid crystal layer interposed between the substrates. In LCDs, voltages are applied to the electric field generating electrodes to generate an electric field between the pixel electrode and the common electrode. Accordingly, an alignment of liquid crystal molecules in the liquid crystal layer is controlled, and a polarization of incident light is thereby controlled. As a result, a desired image is displayed on the LCD.

On a lower substrate of a display apparatus such as an LCD, each pixel is typically defined at an intersection of a gate line, which provides a scanning signal, and a corresponding data line, which provides an image signal. In addition, each pixel includes a thin-film transistor ("TFT") connected to the gate line and the data line, and a pixel electrode connected to the TFT.

The TFT includes a semiconductor layer which forms a channel with a gate electrode (which is part of the gate line), a source electrode (which is part of the data line), a drain electrode and a gate-insulating film, for example. Thus, the TFT is a switching element which delivers or blocks, depending on a state of the TFT, the image signal received from the data line in response to the scanning signal received from the gate line.

As display apparatuses are manufactured to have increased resolution and larger screen sizes, attempts are being made to make parts, which are to be used in the display apparatuses, more compact and/or lighter. In addition, to achieve the increased resolution, required numbers of data lines and gate lines are increased. However, when the required number of data lines is increased, a required number of data drive integrated circuits ("ICs") is also be increased to transmit the image signals to the increased number of data lines. As a result, the size of the display apparatus is substantially increased.

Accordingly, it is desired to develop a display apparatus having reduced size, but maintaining or improving resolution thereof.

Additionally, the increased number of gate lines causes a difference between kickback voltages, due to various parasitic capacitances, and increased flickering, thereby deteriorating image quality of the display apparatus. More specifically, for example, vertical flickering lines (hereinafter referred to as "vertical stains") are displayed on a display apparatus due to a luminance difference between pixels.

Accordingly, it is desired to develop a display apparatus having improved display quality, e.g., a display apparatus with reduced vertical stains.

BRIEF SUMMARY OF THE INVENTION

Exemplary embodiments provide a display apparatus with advantages which include, but are not limited to, substantially reduced vertical flickering lines, e.g., vertical stains. In addition, a display apparatus according to an exemplary embodiment provides data signals to two adjacent pixels along a gate line by using one data line, thereby providing substantially improved resolution without requiring a corresponding increase in size of the display apparatus.

However, alternative exemplary embodiments are not restricted to those described herein. Moreover, the above and other aspects, features and advantages of exemplary embodiments of the present invention will become more readily apparent to those of ordinary skill in the art to which the present invention pertains by referring to the detailed description of the present invention provided below.

According to an exemplary embodiment, a display apparatus includes: a plurality of pixel blocks, each pixel block of the plurality of pixel blocks including a first pixel electrode connected to a first switching element and a second pixel electrode connected to a second switching element; gate lines which extend along a first direction and include a first gate line connected to the first switching element and a second gate line connected to the second switching element; and data lines which extend along a second direction intersecting the first direction. A gate voltage is applied to the first gate line before it is applied to the second gate line, and the first pixel electrodes of each of the pixel blocks display a same color.

According to alternative exemplary embodiment, a display apparatus includes: a plurality of pixel blocks, pixel blocks of the plurality of pixel blocks arranged in a matrix and each of the pixel blocks including a first pixel electrode connected to a first switching element and a second pixel electrode connected to a second switching element; a first gate line disposed above each of the pixel blocks and a second gate line disposed below each of the pixel blocks, the first and second gate lines extending along a row direction of the matrix; and data lines which extend along a column direction of the matrix to intersect the first gate line and the second gate line. The first pixel electrode of each of the pixel blocks is connected to the first gate line, a gate voltage is applied to the first gate line before it is applied to the second gate line. In addition, the second pixel electrode of each of the pixel blocks is connected to the second gate line to which the gate voltage is applied after the first gate line. When the first pixel electrode of each of the pixel blocks displays a red color or a blue color, the second pixel electrode of each of the pixel blocks displays a green color or the blue color blue, and when the first pixel electrode of each of the pixel blocks displays the green color or the blue color, the second pixel electrode of each of the pixel blocks displays the red color or the blue color.

In another alternative exemplary embodiment, a method of driving a display apparatus includes: providing a plurality of pixel blocks, pixel blocks of the plurality of pixel blocks arranged in a matrix and each of the pixel blocks comprising a first pixel electrode connected to a first switching element and a second pixel electrode connected to a second pixel element; providing a first gate line disposed above the pixel blocks and a second gate line disposed below the pixel blocks, the first gate line and the second gate line extending along a row direction of the matrix, the first pixel electrode of each of the pixel blocks being connected to the first gate line and the second pixel electrode of each of the pixel blocks being connected to the second gate line; providing data lines which extend in a column direction of the matrix to intersect the first gate line and the second gate line; applying a gate voltage to the first gate line before applying the gate voltage to the second gate line; displaying a red color or a blue color with the first pixel electrode of each of the pixel blocks displays when the second pixel electrode of each of the pixel blocks displays a green color or the blue color; and displaying the green color or the blue color with the first pixel electrode of each of the pixel blocks displays when the second pixel electrode of each of the pixel blocks displays the red color or the blue color.

BRIEF DESCRIPTION OF THE DRAWINGS

The above and other aspects, advantages and features of the present invention will become more readily apparent by describing in further detail exemplary embodiments thereof with reference to the accompanying drawings, in which.

DETAILED DESCRIPTION OF THE INVENTION

Figure 1:
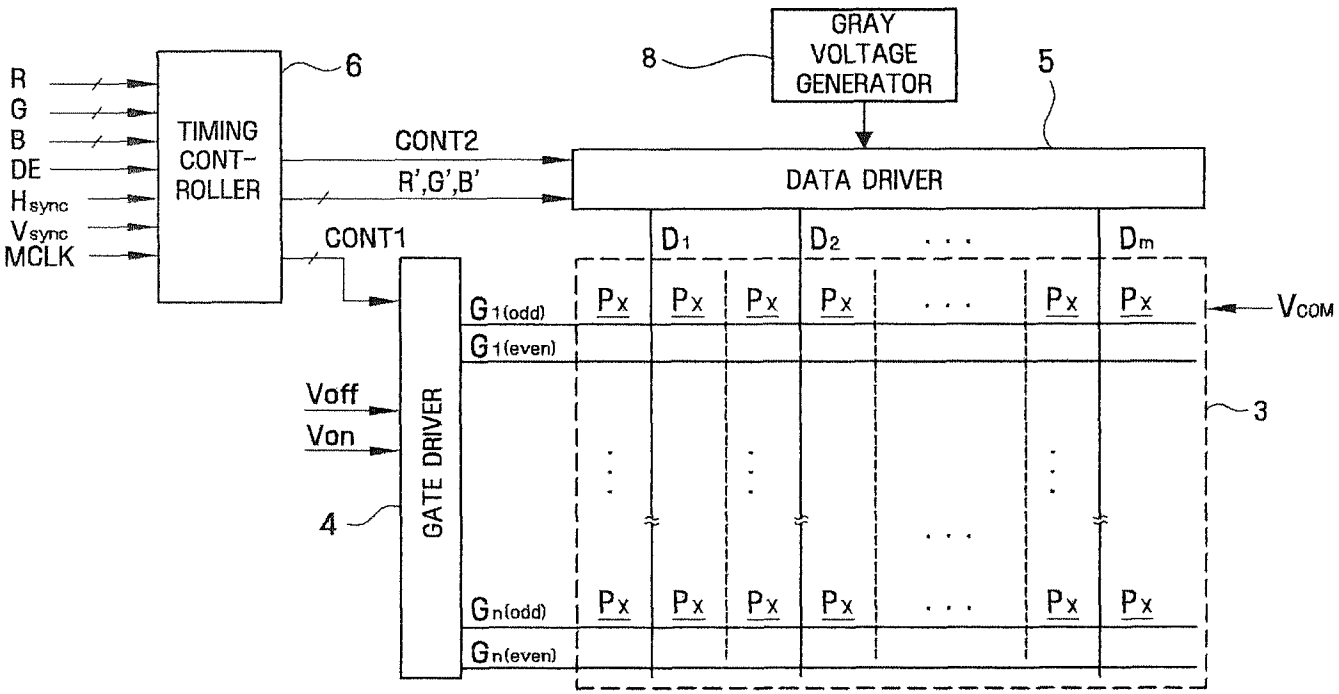
FIG. 1 is a block diagram of an exemplary embodiment of a display apparatus according to the present invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, exemplary embodiments of the present invention will be described in further detail with reference to the accompanying drawings.

Figure 2:
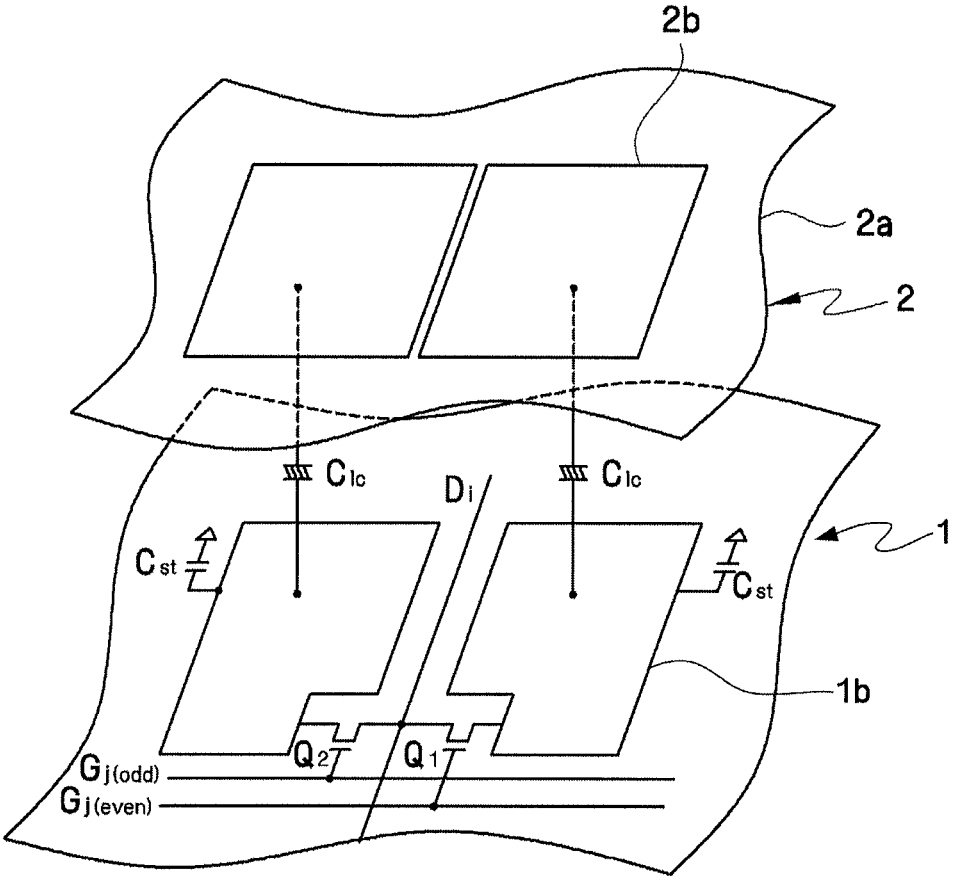
FIG. 2 is an equivalent circuit diagram of two pixels included in the display apparatus of FIG. 1.

FIG. 1 is a block diagram of an exemplary embodiment of a display apparatus according to the present invention. FIG. 2 is an equivalent circuit diagram of two pixels included in the display apparatus of FIG. 1.

Referring to FIGS. 1 and 2, a display apparatus according to an exemplary embodiment includes a display panel 3, a gate driver 4 connected to the display panel 3, a data driver 5, a gray voltage generator 8 connected to the data driver 5 and a timing controller 6 which controls the above-listed elements.

As shown in FIG. 2, the display panel 3 includes a lower substrate 1 and an upper substrate 2. The lower substrate 1 includes display signal lines and pixels Px connected to the display signal lines and arranged in a matrix including rows and columns.

The display signal lines include gate lines G1(odd) and G1(even) through Gn(odd) and Gn(even), which transmit gate signals, and data lines D1 through Dm, which transmit data signals.

The gate lines G1(odd) and G1(even) through Gn(odd) and Gn(even) extend along a first, substantially row, direction and are substantially parallel to each other. Each of the gate lines G1(odd) and G1(even) through Gn(odd) and Gn(even) includes an odd gate line and an even gate line. The data lines D1 through Dm extend along a second, substantially column, direction crossing the first direction and are substantially parallel to each other. In an exemplary embodiment, the first direction is substantially perpendicular to the second direction.

Each of the gate lines G1(odd) and G1(even) through Gn(odd) and Gn(even) includes a pair having an odd gate line an even gate line arranged along the row direction. In an exemplary embodiment, each pair of odd and even gate lines may extend in a same direction as a corresponding pixel row of the matrix of pixels Px.

Each pixel Px includes a switching element Q1 or Q2 connected to one of the gate lines G1(odd) and G1(even) through Gn(odd) and Gn(even) and one of the data lines D1 through Dm, a liquid crystal capacitor Clc and a storage capacitor Cst connected to the switching element Q1 or Q2. In an alternative exemplary embodiment, the storage capacitor Cst may be omitted.

The switching elements Q1 and Q2 may be included in the lower substrate 1. Each of the switching elements Q1 and Q2 is a three-terminal device that includes a gate electrode and a source electrode connected to one of the gate lines G1(odd) and G1(even) through Gn(odd) and Gn(even) and one of the data lines D1 through Dm, respectively, and a drain electrode connected to the liquid crystal capacitor Clc and the storage capacitor Cst.

The switching elements Q1 and Q2 are disposed on two sides of a data line. More specifically, the switching element Q1 disposed on a left side of the data line has the gate electrode connected to an odd gate line of a pair of gate lines, and the switching element Q2 disposed on a right side of the data line has the gate electrode connected to an even gate line of the pair of gate lines, thereby forming a pixel row, as shown in FIG. 2. Alternative exemplary embodiments are not limited to the aforementioned description, e.g., the switching element Q1 disposed on the left side of the data line may have the gate electrode connected to the even gate line of the pair of gate lines, and the switching element Q2 disposed on the right side of the data line may have the gate electrode connected to the odd gate line of the pair of gate lines, thereby forming the pixel row.

The source electrode of the switching element Q1 disposed on the left side of the data line and the source electrode of the switching element Q2 disposed on the right side of the data line are connected to the data line.

Each of the odd gate lines G1(odd) through Gn(odd) and each of the even gate lines G1(even) through Gn(even) form pairs which deliver gate signals to a pair of source electrodes connected to a data line.

The liquid crystal capacitor Clc includes a pixel electrode 1*b* of the lower substrate 1 and a common electrode 2*a* of an upper substrate 2 as terminals, and a liquid crystal layer (not shown) between the pixel electrode 1*b* and the common electrode 2*a* is a dielectric substance. The pixel electrode 1*b* is connected to the switching element Q1 or Q2. In an exemplary embodiment, the common electrode 2*a* is disposed on an entire surface of the upper substrate 2 and receives a common voltage Vcom. In an alternative exemplary embodiment, the common electrode 2*a* may be included in the lower substrate 1. In this case, both of the pixel electrode 1*b* and the common electrode 2*a* may be substantially linear or, alternatively, bar-shaped.

The storage capacitor Cst is formed by overlapping at least a portion of the pixel electrode 1*b* and a separate signal line (not shown) included in the lower substrate 1. In an exemplary embodiment, a predetermined voltage, such as the common voltage Vcom, is applied to the separate signal line. In addition, the storage capacitor Cst may be formed by overlapping at least a portion of the pixel electrode 1*b* and a previous gate line disposed above a current gate line, using an insulator as a medium.

In an exemplary embodiment of the display apparatus, each pixel Px represents a color to display a color image, for example. Accordingly, a color filter 2*b*, e.g., a red, green, or blue color filter, is disposed in a region corresponding to the pixel electrode 1*b*. As shown in FIG. 2, the color filter 2*b* is disposed in a region corresponding to the upper substrate 2. However, in an alternative exemplary embodiment, the color filter 2*b* may be disposed on or, alternatively, under the pixel electrode 1*b* of the lower substrate 1.

A polarizer (not shown) which polarizes light is disposed at an outer surface of at least one of the lower substrate 1 and the upper substrate 2.

The gray voltage generator 8 generates at least two sets of gray voltages related to transmittance of a given pixel Px. One of the two sets of gray voltages has a positive value, with respect to the common voltage Vcom, and the other has a negative value with respect to the common voltage Vcom.

The gate driver 4 is connected to the gate lines G1(odd) and G1(even) through Gn(odd) and Gn(even) of the lower substrate 1 and transmits a gate signal (e.g., a gate-on voltage Von or a gate-off voltage Voff) to each of the gate lines G1(odd) and G1(even) through Gn(odd) and Gn(even).

The data driver 5 is connected to the data lines D1 through Dm of the lower substrate 1. The data driver 5 selects a gray voltage received from the gray voltage generator 8 and applies the gray voltage to a corresponding pixel Px as a data signal. In an exemplary embodiment, the data driver 5 includes integrated circuits ("ICs").

The timing controller 6 generates control signals for controlling the gate driver 4 and the data driver 5 and transmits the control signals to the gate driver 4 and/or the data driver 5.

A display operation of the display apparatus according to an exemplary embodiment will now be described in further detail.

The timing controller 6 receives, from an external graphics controller (not shown), red, green and blue image signals R, G and B and input control signals (e.g., a vertical synchronization signal Vsync, a horizontal synchronization signal Hsync, a main clock signal Mclk and a data enable signal DE) for controlling the display of the image signals R, G and B. The timing controller 6 generates gate control signals CONT1 and data control signals CONT2 based on the input control signals. In addition, the timing controller 6 processes the image signals R, G and B according to operating conditions of the lower substrate 1, and generates image data R', G' and B'. The timing controller 6 transmits the gate control signals CONT1 to the gate driver 4 and transmits the data control signals CONT2 and image data R', G' and B' to the data driver 5.

The gate control signals CONT1 include a vertical synchronization start signal (not shown) that instructs the output of a gate-on pulse (a gate-on voltage section) to begin, a gate clock signal (not shown) that controls when to output the gate-on pulse, and an output enable signal (not shown) that determines a width of the gate-on voltage Von.

The data control signals CONT2 include a horizontal synchronization start signal (not shown) that instructs the input of the image data R', G' and B' to begin, a load signal (not shown) that instructs a data voltage to be applied to a corresponding one of the data lines D1 through Dm, an inversion signal (not shown) that inverts a polarity of a data voltage (with respect to a polarity of the common voltage Vcom), and a data clock signal (not shown). Hereinafter, "the polarity of a data voltage with respect to that of the common voltage Vcom" will be referred to as "the polarity of a data voltage."

The data driver 5 sequentially receives the image data R', G' and B' corresponding to a row of pixels in response to the data control signals CONT2 from the timing controller 6, selects gray voltages which correspond to the image data R', G' and B' from the gray voltages received from the gray voltage generator 8, and converts the image data R', G' and B' into data voltages.

The gate driver 4 applies the gate-on voltage Von having a period of ½H (where "H" is one horizontal period) to each of the odd and even gate lines G1(odd) and G1(even) through Gn(odd) and Gn(even) in response to the vertical synchronization start signal and the gate clock signal from the timing controller 6, thereby turning on the switching element Q1 or Q2 connected to each of the gate lines G1(odd) and G1(even) through Gn(odd) and Gn(even). The gate-on voltage Von may be sequentially applied to each of the gate lines G1(odd) and G1(even) through Gn(odd) and Gn(even) in the column direction of the matrix of pixels Px. Alternatively, the gate-on voltage may be sequentially applied to each of the odd gate lines G1(odd) through Gn(odd) in the pixel column direction, and then to each of the even gate lines G1(even) through Gn(even) in the pixel column direction.

When the gate-on voltage Von is applied to a pair of odd and even gate lines of the gate lines G1(odd) and G1(even) through Gn(odd) and Gn(even), a row of the switching elements Q1 and Q2 connected to the pair of odd and even gate lines are turned on. While the switching elements Q1 and Q2 are turned on, the data driver 5 applies data voltages to a corresponding data line of the data lines D1 through Dm. Then, each data voltage applied to the corresponding one of the data lines D1 through Dm is delivered to a corresponding pixel Px via the turned-on switching element Q1 or Q2.

Liquid crystal molecules (not shown) in the liquid crystal layer (not shown) change alignment according to an electric field generated by the pixel electrode 1*b* and the common electrode 2*a*. Accordingly, a polarization of light passing through the liquid crystal layer is controlled. The polarization of the light controls a transmittance of light by the polarizer (not shown) which is disposed on at least one of the lower substrate 1 and the upper substrate 2. Thus, a desired image is displayed on the display apparatus according to an exemplary embodiment.

Thus, during a present frame, e.g., a first frame, the gate-on voltage Von is sequentially applied to all gate lines G1(odd) and G1(even) through Gn(odd) and Gn(even), and data voltages are applied to all pixels Px.

A state of the inversion signal transmitted to the data driver 5 is controlled such that a next frame, e.g., a second frame, begins when the first frame ends and a polarity of a data voltage applied to each pixel Px in the second frame is opposite to the polarity of the data voltage during the first frame (e.g., "frame inversion"). In addition, within a given frame, a polarity of a data voltage that flows through a data line may be changed according to characteristics of the inversion signal (e.g., "line inversion"). Also, data voltages with different polarities may be applied to a given row of pixels (e.g., "dot inversion").

Thus, the pixels Px disposed on the lower substrate 1 according to an exemplary embodiment enables a single data line to deliver data voltages to a pair of the pixels. Thus, a required number of data lines is reduced by half, whereas the number of gate lines doubles. In addition, the gate driver 4 according to an exemplary embodiment is integrated onto one side of the lower substrate 1; accordingly, a size of the lower substrate 1 is not increased even though the number of gate lines is doubled. Thus, in an exemplary embodiment, there is no need to increase the size of the lower substrate 1 to accommodate the gate driver 4. In an alternative exemplary embodiment, the gate driver 4 may be integrated onto both sides of the lower substrate 1, to negate needing to increase the size of the gate driver 4.

Furthermore, since the number of pixels of the display apparatus according to an exemplary embodiment is twice the number of pixels of a conventional display apparatus, while the screen size remains unchanged, the display apparatus according to an exemplary embodiment provides resolution that is twice a resolution of the conventional display apparatus.

Figure 3:
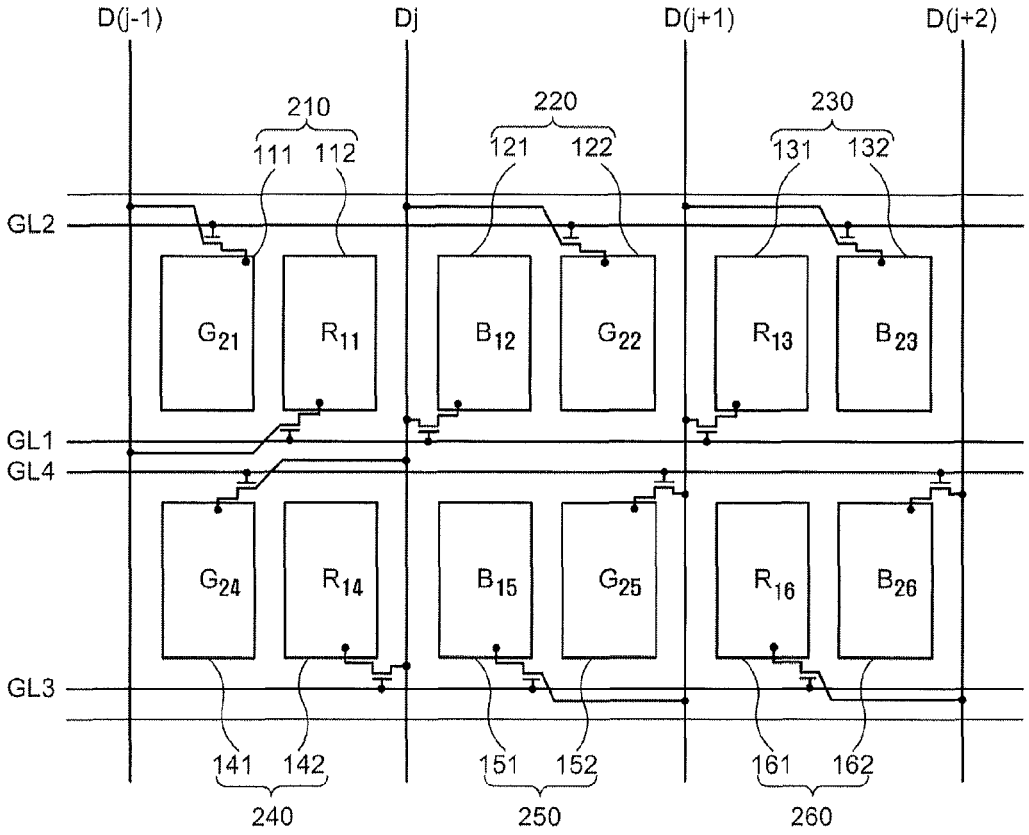
FIG. 3 is a plan view illustrating an arrangement of pixel electrodes in an exemplary embodiment of a display apparatus according to the present invention.

FIG. 3 is a plan view illustrating an arrangement of pixel electrodes in an exemplary embodiment of a display apparatus according to the present invention.

Referring to FIG. 3, each pair of first pixel electrode and second pixel electrodes included in the display apparatus according to an exemplary embodiment will hereinafter be referred to as a pixel block. In an exemplary embodiment, an operation and configuration of the display apparatus including pixel electrodes included in six pixel blocks, e.g., a first pixel block 210, a second pixel block 220, a third pixel block 230, a fourth pixel block 240, a fifth pixel block 250 and a sixth pixel block 260 (hereinafter referred to as "six pixel blocks 210 through 260"), will be described in further detail. As shown in FIG. 3, each pixel block of the six pixel blocks 210 through 260 includes a pixel electrode. More specifically, and as will also be described in further detail below, the first pixel block 210 includes pixel electrodes 111 and 112, the second pixel block 220 includes pixel electrodes 121 and 122, the third pixel block 230 includes pixel electrodes 131 and 132, the fourth pixel block 240 includes pixel electrodes 141 and 142, the fifth pixel block 250 includes pixel electrodes 151 and 152 and the sixth pixel block 260 includes pixel electrodes 161 and 162. As shown in FIG. 3, in an exemplary embodiment, the six pixel blocks 210 through 260 are arranged in a 2×3 matrix, e.g., a matrix including three columns and two rows, and are connected to one of a first gate line GL1, a second gate line GL2, a third gate line GL3 and a fourth gate line GL4, which are driven sequentially.

In FIGS. 3 and 5-7, each pixel electrode is labeled using the form "$C_{XY}$," in which: "C" denotes a color, e.g., red R, green G and blue B indicating the color of an associated color filter 2*b* (FIG. 2) correspond to the associated pixel electrode; subscript "X" indicates whether a specified pixel electrode is the first pixel electrode or the second pixel electrode; and subscript "Y" indicates in which pixel block a specified pixel electrode is included. For example, the $G_{21}$ pixel electrode 111 is the second pixel electrode included in the first pixel block 210. As shown in FIG. 3, each pixel block of the six pixel blocks 210 through 260 includes a pair of the pixel electrodes which are arranged side by side in a given row of the 2×3 matrix. For example, the first pixel block 210 includes a $G_{21}$ pixel electrode 111, e.g., a green second pixel included in the first pixel block, and an $R_{11}$ pixel electrode 112, e.g., a red first pixel included in the first pixel block. Likewise, the second pixel block 220 includes a $B_{12}$ pixel 121 and a $G_{22}$ pixel 122, while the third pixel block 230 includes a $R_{13}$ pixel 131 and a $B_{23}$ pixel 132. Similarly, the fourth pixel block 240 includes a $G_{24}$ pixel electrode 141 and an $R_{14}$ pixel electrode 142, the fifth pixel block 250 includes a $B_{15}$ pixel 151 and a $G_{25}$ pixel 152, and the sixth pixel block 260 includes a $R_{16}$ pixel 161 and a $B_{26}$ pixel 162. Thus, in an exemplary embodiment, $G_{21}$, $R_{11}$; $B_{12}$, $G_{22}$; $R_{13}$, $B_{23}$; $G_{24}$, $R_{14}$; ($B_{15}$, $G_{25}$; and $R_{16}$, $B_{26}$ pixel electrodes 111, 112; 121, 122; 131, 132; 141, 142; 151, 151; and 161, 162, respectively, are arranged sequentially in the above-listed order in the first through sixth pixel blocks 210 through 260, respectively, which are disposed in the two rows and the three columns.

More specifically, as shown in FIG. 3, in a first row, the $G_{21}$, $R_{11}$; $B_{12}$, $G_{22}$; and $R_{13}$, $B_{23}$ pixel electrodes 111, 112; 121, 122; and 131, 132, respectively, are arranged in the first through third pixel blocks 210 through 230, respectively. In a second row, the $G_{24}$, $R_{14}$; $B_{15}$, $G_{25}$; and $R_{12}$, $B_{26}$ pixel electrodes 141, 142; 151, 152; and 161, 162, respectively, are arranged in the fourth through sixth pixel blocks 240 through 260, respectively.

In an exemplary embodiment, the first pixel electrode, indicated by a one (1) for the subscript "X" in "$C_{XY}$," denotes a pixel electrode charged when a gate voltage is applied to the first gate line GL1 or the third gate line GL3, and the second pixel electrode, indicated by a two (2) for the subscript "X" in "$C_{XY}$," denotes a pixel electrode charged when the gate voltage is applied to the second gate line GL2 or the fourth gate line GL4.

In FIGS. 3 through 7, the first through fourth gate lines GL1 through GL4, respectively, will be described according to a time sequence in which they are operated, but, for purposes of simplicity, the first gate line GL1 and the second gate line GL2 will primarily be described, e.g., any repetitive detailed description will be omitted.

Referring again to FIG. 3, when a gate voltage is applied to the first gate line GL1, the $R_{11}$, $B_{12}$, and $R_{13}$ pixel electrodes 112, 121, and 131, respectively, are charged with data voltages that are applied to data lines D(j−1), Dj, and D(j+1), respectively. When the gate voltage is applied to the second gate line GL2, the $G_{21}$, $G_{22}$, and $B_{23}$ pixel electrodes 111, 122, and 132, respectively, are charged with data voltages that are applied to the data lines D(j−1), Dj, and D(j+1), respectively. When the gate voltage is applied to the third gate line GL3, the $R_{14}$, $B_{15}$, and $R_{16}$ pixel electrodes 142, 151, and 161, respectively, are charged with data voltages that are applied to the data lines D(j−1), Dj, and D(j+1), respectively. Additionally, when the gate voltage is applied to the fourth gate line GL4, the $G_{24}$, $G_{25}$, and $B_{26}$ pixel electrodes 141, 152, and 162, respectively, are charged with data voltages that are applied to the data lines D(j−1), Dj, and D(j+1), respectively.

It will be noted that alternative exemplary embodiments are not limited to the above-mentioned configuration; instead, a color-based operation may be implemented. Specifically, for example, red (R) pixel electrodes (e.g., $R_{11}$, $R_{13}$, $R_{14}$ and $R_{16}$) are charged when a gate voltage is applied to the first and third gate lines GL1 and GL3, respectively. Green (G) pixel electrodes (e.g., $G_{21}$, $G_{22}$, $G_{24}$ and $G_{25}$) are charged when the gate voltage is applied to the second and fourth gate lines GL2 and GL4, respectively. Blue (B) pixel electrodes (e.g., $B_{12}$, $B_{23}$, $B_{15}$ and $B_{26}$) are charged with the gate voltage is applied to the first through fourth gate lines GL1 through GL4, respectively.

In the red pixel electrodes, a first kickback voltage and a second kickback voltage are generated. Specifically, the red pixel electrodes are charged before the green pixel electrodes or the blue pixel electrodes adjacent thereto are charged. Thus, when power supplied to the red pixel electrodes is cut off, the first kickback voltage is generated. Later, when power supplied to the green pixel electrodes or the blue pixel electrodes adjacent to the red pixel electrodes is cut off, the second kickback voltage is generated, as will be described in further detail below with reference to FIGS. 4A and 4B.

Alternatively, in an exemplary embodiment, only the first kickback voltage is generated in the green pixel electrodes. Specifically, the green pixel electrodes are charged later than the red pixel electrodes or the blue pixel electrodes adjacent thereto. Thus, when power supplied to the green pixel electrodes is cut off, only the first kickback voltage is generated.

Therefore, in, the second kickback voltage is generated in the red pixel electrodes and the first kickback voltage is generated in the green pixel electrodes. However, the generation of the second kickback voltage makes it difficult for a given pixel electrode to maintain a constant voltage. This notwithstanding, when the second kickback voltage is generated only in the red pixel electrodes or the green pixel electrodes, as in an exemplary, vertical flickering lines, e.g., vertical stains, are substantially reduced and/or are effectively eliminated. For example, when the second kickback voltage is generated only in the red pixel electrodes, a deterioration of visibility (e.g., the vertical stains) resulting from the generation of the second kickback voltage in the green and/or blue pixel electrodes around the red pixel electrodes is substantially reduced. In addition, since the second kickback voltage is generated only in the red pixel electrodes, data voltages applied to the red pixel electrodes can be easily adjusted accordingly. A process in which the second kickback voltage is generated will be described in further detail below.

The second kickback voltage may be generated in the blue pixel electrodes connected to the first and third gate lines GL1 and GL3, respectively, and is not be generated in the blue pixel electrodes connected to the second and fourth gate lines GL2 and GL4, respectively. However, since a visibility of blue color is low compared to other colors, even when vertical stains are formed, due to the generation of the second kickback voltage in the blue pixel electrodes, the vertical stains are not recognized as defects, and a display quality of an exemplary embodiment is not deteriorated.

Figure 4A:
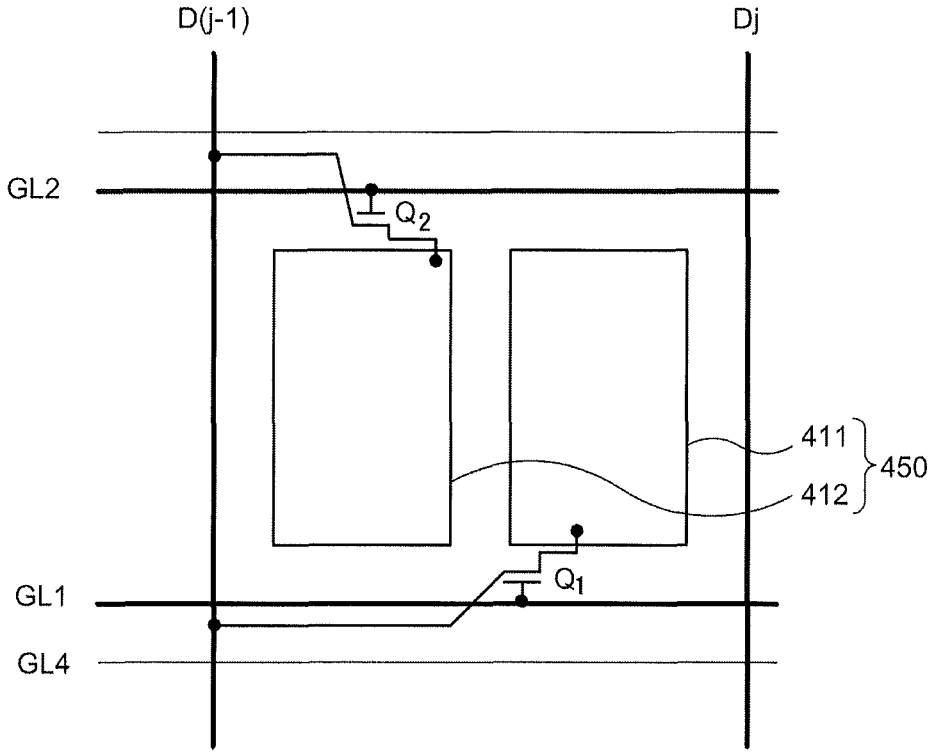
FIG. 4A is a plan view illustrating an arrangement of pixel electrodes included in one pixel block of an exemplary embodiment of a display apparatus according to the present invention.
Figure 4B:
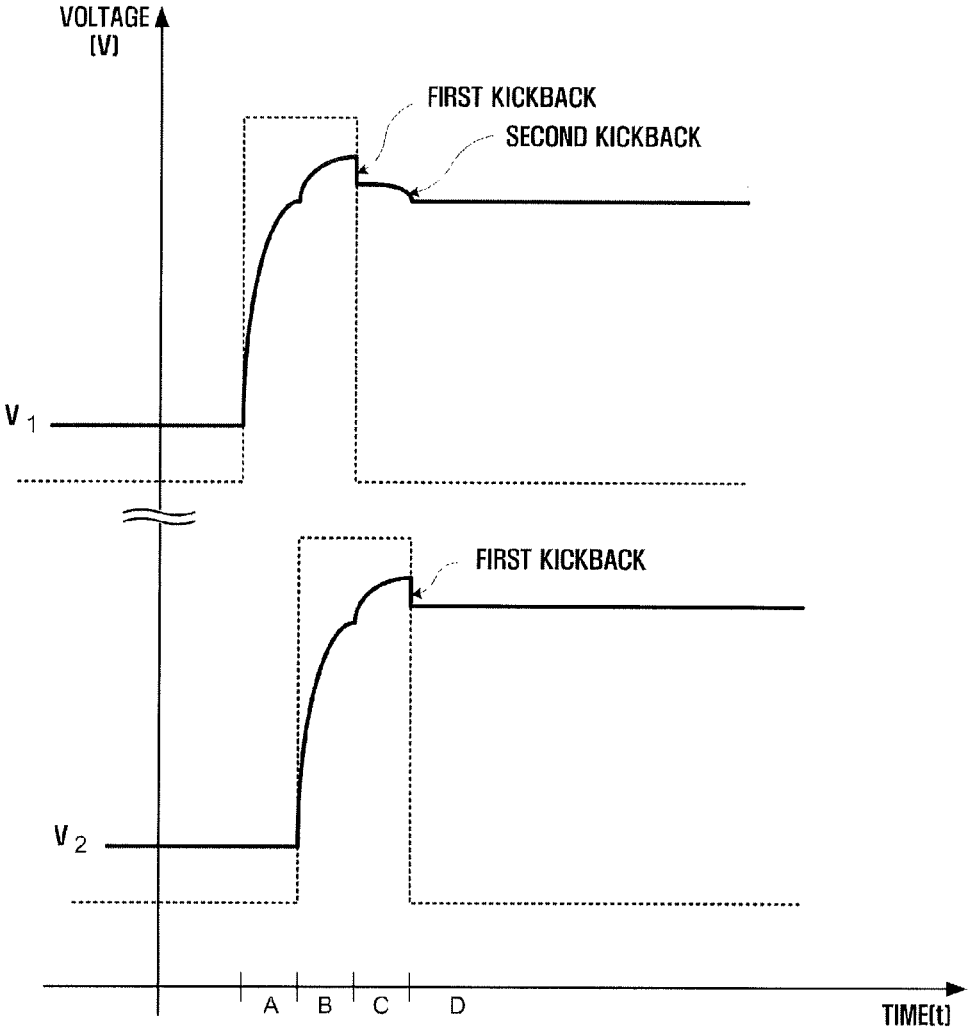
FIG. 4B is a graph of voltage versus time illustrating voltage profiles of a first pixel electrode and a second pixel electrode included in the display apparatus of FIG. 4A.

FIG. 4A is a plan view illustrating an arrangement of pixel electrodes included in one pixel block of an exemplary embodiment of a display apparatus according to the present invention. FIG. 4B is a graph of voltage (V) versus time (t) illustrating voltage profiles of a first pixel electrode 411 and a second pixel electrode 412 of the display apparatus shown in FIG. 4A.

Referring to FIG. 4A, a pixel block 450 may be disposed between two gate lines (e.g., a first gate line GL1 and a second gate line GL2) and two data lines (e.g., a first data line D(j−1) and a second data line Dj). In the pixel block 450, a first pixel electrode 411 and a second pixel electrode 412 are arranged in a row.

When a gate voltage is applied to the first gate line GL1, a switching element $Q_1$ is driven, e.g., is turned on, and thus a voltage applied to the first data line D(j−1) is supplied to the first pixel electrode 411. Similarly, when the gate voltage is applied to the second gate line GL2, a voltage applied to the first data line D(j−1) is supplied to the second pixel electrode 412.

As shown in FIG. 4A, the first pixel electrode 411 is charged when the gate voltage is applied to the first gate line GL1, and the second pixel electrode 412 is charged when the gate voltage is later applied to the second gate line GL2, e.g., after the gate voltage is applied to the first gate line GL1.

FIG. 4B shows the voltage profiles of the first pixel electrode 411 and the second pixel electrode 412 when data voltages are sequentially and simultaneously applied to the first pixel electrode 411 and the second pixel electrode 412 for a predetermined period of time.

More specifically, in FIG. 4B, a period of time during which a gate voltage is applied is divided into sections A through D, and magnitudes of a first voltage $V_1$ of the first pixel electrode 411 and a second voltage $V_2$ of the second pixel electrode 412 in each of the sections A through D are shown.

In the section A, the gate voltage is applied to the first gate line GL1, and a data voltage is applied to the first pixel electrode 411 via the switching element $Q_1$ which is connected to the first pixel electrode 411. This process is referred to as free charge process.

In the section B, a main data voltage is applied to the first pixel electrode 411. This process is referred to as a main charge process. While the main charge process is performed on the first pixel electrode 411 in response to a main charge signal, the free charge process is performed on the second pixel electrode 412 in response to the main charge signal.

In the section C, the application of the gate voltage to the first pixel electrode 411 is stopped. Accordingly, a first pixel voltage of the first pixel electrode 411 is reduced by the first kickback voltage generated as a result of a first kickback. In addition, the main charge process is performed on the second pixel electrode 412. When the gate voltage is applied to the second gate line GL2, a data voltage is applied to the second pixel electrode 412.

In the section D, the application of the gate voltage to the second gate line GL2, which turns on the switching element Q2, is stopped. Accordingly, a second pixel voltage of the second pixel electrode 412 is reduced by the first kickback voltage generated as a result of the first kickback. When the application of the gate voltage to the second gate line GL2 is stopped, the first pixel voltage of the first pixel electrode 411 adjacent to the second gate line GL2 is reduced by the second kickback voltage generated as a result of a second kickback.

As described herein, while both of the first and second pixel voltages of the first and second pixel electrodes 411 and 412, respectively, are reduced by the first kickback voltage, only the first pixel voltage of the first pixel electrode 411 is reduced by the second kickback voltage. Thus, in a pair of the first pixel electrode 411 and the second pixel electrode 412 disposed between the first gate line GL1 and the second gate line GL2, only the first pixel electrode 411, to which a data voltage is applied first, experiences a voltage drop due to the second kickback voltage. However, the second pixel electrode 412, to which a data voltage is later applied, does not experience a voltage drop due to the second kickback voltage. Accordingly, when red, green and blue pixel electrodes (best shown in FIG. 3) are arranged such that one of the red, green and blue pixel electrodes is the first pixel electrode 411, voltage drops due to the second kickback voltage occur in all of the red, green and blue pixel electrodes, thereby causing the formation of the vertical stains (e.g., the vertical flickering lines).

However, referring again to FIG. 3, in an exemplary embodiment, the $R_{11}$, $R_{13}$, $R_{14}$, and $R_{16}$ pixel electrodes 112, 131, 142 and 161, respectively, which display red, are correspond only to the first pixel electrode 411, and the $G_{21}$, $G_{22}$, $G_{24}$ and $G_{25}$ pixel electrodes 111, 122, 141 and 152, respectively, which display green, correspond only to the second pixel electrode 412. Alternatively, the $G_{21}$, $G_{22}$, $G_{24}$ and $G_{25}$ pixel electrodes 111, 122, 141 and 152, respectively, which display green, may correspond only to the first pixel electrode 141, and the $R_{11}$, $R_{13}$, $R_{14}$ and $R_{16}$ pixel electrodes 112, 131, 142 and 161, respectively, which display red, correspond only to the second pixel electrode 412.

Therefore, as shown in FIG. 3, according an exemplary embodiment, the red, green and blue pixel electrodes are arranged in an order such that the second kickback voltage is generated only in pixel electrodes which display a same color. Consequently, vertical stains are substantially reduced. For example, pixel electrodes which display red or, alternatively, pixel electrodes which display green correspond to the first pixel electrode 141. Since visibility of blue is inherently low (as compared to visibility of red and green), even when the B pixel electrodes correspond to either the first pixel electrode 411 or the second pixel electrode 412, vertical stains, e.g., defects therein are not visible.

Thus, in an exemplary embodiment, when pixel electrodes which represent the same color (e.g., red or green) correspond to the first pixel electrode 141 or the second pixel electrode 412, formation of the vertical stains on the display apparatus, which includes a plurality of pixel blocks, each having a pair of pixel electrodes, is substantially reduced and/or is effectively minimized.

Figure 5:
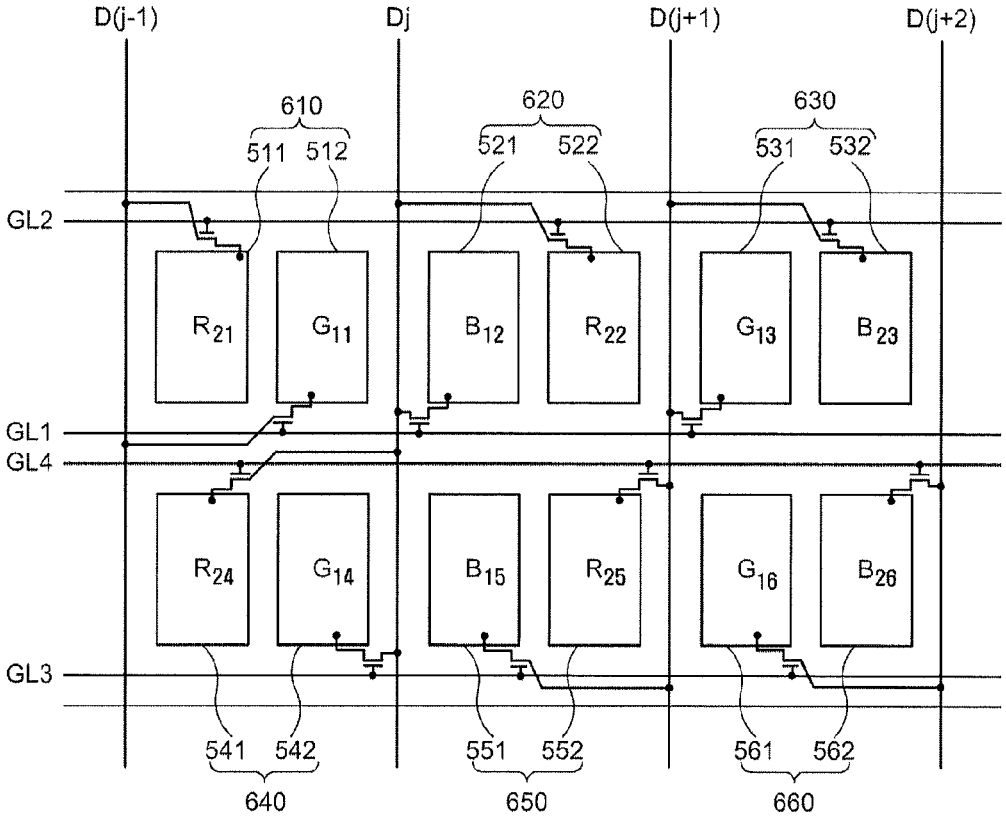
FIG. 5 is a plan view illustrating an arrangement of pixel electrodes in an alternative exemplary embodiment of a display apparatus according to the present invention.

FIG. 5 is a plan view illustrating an arrangement of pixel electrodes in an alternative exemplary embodiment of a display apparatus according to the present invention.

Referring to FIG. 5, first through sixth pixel blocks 610 through 660, respectively, are arranged in two rows and three columns of a 2×3 matrix and are connected to first thorough fourth gate lines GL1 through GL4, respectively, similar to as described above with reference to the exemplary embodiment shown in FIG. 3. It will be noted that the same labeling convention, e.g., "$C_{XY}$," as described above in further detail and used in FIG. 3 is used in FIGS. 5-7, and any repetitive detailed explanation thereof will hereinafter be omitted.

Each pixel block includes a pair of pixel electrodes (e.g., pairs 511, 512; 521, 522; 531, 532; 541, 542; 551, 552; and 561, 562) which are arranged side by side in rows. For example, the first pixel block 610 includes an $R_{21}$ pixel electrode 511 and a $G_{11}$ pixel electrode 512 while the fourth pixel block 640 may include an $R_{24}$ pixel electrode 541 and a $G_{14}$ pixel electrode 542. Thus, pairs of pixel electrodes $R_{21}$, $G_{11}$; $B_{12}$, $R_{22}$, $G_{13}$, $B_{23}$; $R_{24}$, $G_{14}$; $B_{15}$, $R_{25}$; and $G_{16}$, $B_{26}$ are arranged sequentially in the above-listed order in the first through sixth pixel blocks 610 through 660, respectively, arranged in two rows and three columns.

When a gate voltage is applied to the first gate line GL1, the $G_{11}$, $B_{12}$, and $G_{13}$ pixel electrodes 512, 521, and 531, respectively, are charged with data voltages applied to data lines D(j−1), Dj, and D(j+1), respectively. When the gate voltage is applied to the second gate line GL2, the $R_{21}$, $R_{22}$, and $B_{23}$ pixel electrodes 511, 522, and 532, respectively, are charged with data voltages applied to the data lines D(j−1), Dj, and D(j+1), respectively. Likewise, when the gate voltage is applied to the third gate line GL3, the $G_{14}$, $B_{15}$, and $G_{16}$ pixel electrodes 542, 551, and 561, respectively, are charged with data voltages applied to the data lines D(j−1), Dj, and D(j+1), respectively. Additionally, when the gate voltage is applied to the fourth gate line GL4, the $R_{24}$, $R_{25}$, and $B_{26}$ pixel electrodes 541, 552, and 562, respectively, are charged with data voltages applied to the data lines D(j−1), Dj, and D(j+1), respectively.

In an alternative exemplary embodiment, a color-based operation may be utilized. Specifically, green (G) pixel electrodes (e.g., $G_{11}$, $G_{13}$, $G_{14}$ and $G_{16}$) are charged when a gate voltage is applied to the first and third gate lines GL1 and GL3, respectively. Red (R) pixel electrodes (e.g., $R_{21}$, $R_{22}$, $R_{24}$ and $R_{25}$) are charged when the gate voltage is applied to the second and fourth gate lines GL2 and GL4. In addition, blue (B) pixel electrodes (e.g., $B_{12}$, $B_{23}$, $B_{15}$ and $B_{26}$) are charged with the gate voltage applied to the first through fourth gate lines GL1 through GL4.

Therefore, the green pixel electrodes (e.g., $G_{11}$, $G_{13}$, $G_{14}$, and $G_{16}$) which display green are first pixel electrodes, and the R pixel electrodes (e.g., $R_{21}$, $R_{22}$, $R_{22}$, $R_{24}$, and $R_{25}$) which display red are second pixel electrodes. As described above, pixel voltages of the first pixel electrodes may be reduced by a second kickback voltage generated as a result of a second kickback.

In an exemplary embodiment, however, when the greed pixel electrodes (e.g., $G_{11}$, $G_{13}$, $G_{14}$ and $G_{16}$) are the first pixel electrodes in which the second kickback occurs, the second kickback occurs only in the green pixel electrodes which represent the same color, e.g., green. Consequently, non-uniform voltage fluctuations of the red and green pixel electrodes, which cause vertical stains, are substantially reduced, thereby substantially reducing the formation of the vertical stains on the display apparatus according to an exemplary embodiment.

The blue pixel electrodes may be either the first pixel electrodes or the second pixel electrodes. As noted above, since visibility of blue is low (relative to green and red), voltage fluctuations of the blue pixel electrodes resulting from the second kickback are not recognized as vertical stains. Thus, a defect rate due to vertical stains is substantially reduced in a display apparatus according to an exemplary embodiment.

Figure 6:
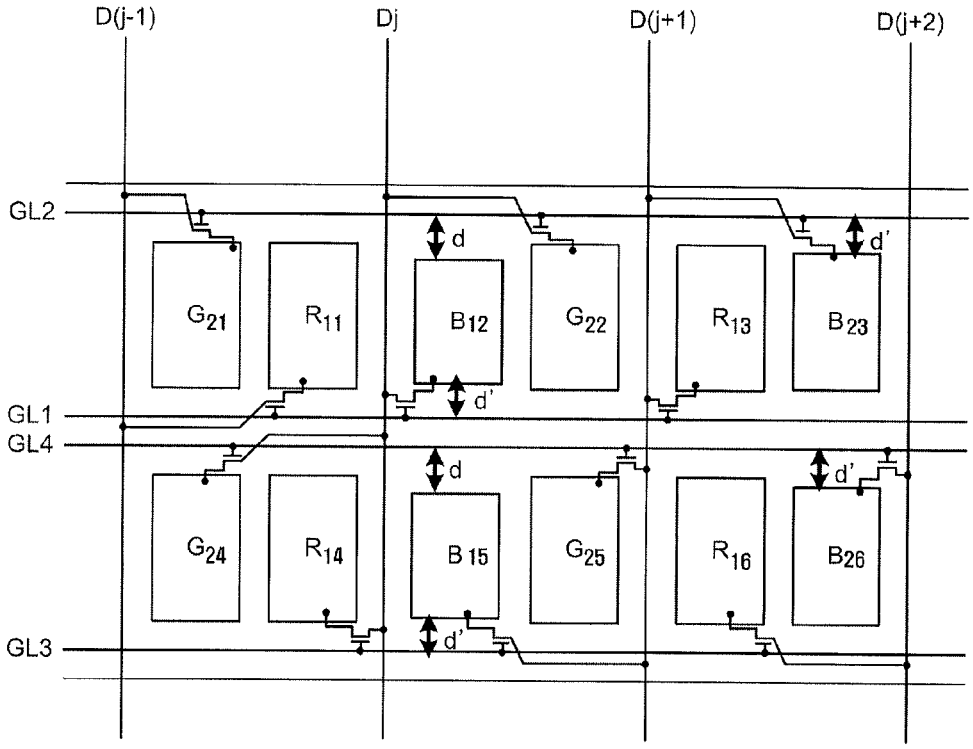
FIG. 6 is a plan view illustrating an arrangement of pixel electrodes in another alternative exemplary embodiment of a display apparatus according to the present invention.

FIG. 6 is a plan view illustrating an arrangement of pixel electrodes in another alternative exemplary embodiment of a display apparatus according to the present invention.

Referring to FIG. 6, and similarly as described in further detail above with reference to the exemplary embodiment shown in FIG. 3, six pixel blocks arranged in a 2×3 matrix and connected to four gate lines (e.g., first through fourth gate lines GL1 through GL4, respectively) are disposed in a display apparatus according to an exemplary embodiment. Thus, pixel electrode pairs $G_{21}$, $R_{11}$; $B_{12}$, $G_{22}$; $R_{13}$, $B_{23}$; $G_{24}$, $R_{14}$; $B_{15}$, $G_{25}$; and $R_{16}$, $B_{26}$ are arranged sequentially in the above-listed order in the six pixel blocks which are arranged in two rows and three columns.

As shown in FIG. 3, red pixel electrodes (e.g., $R_{11}$, $R_{13}$, $R_{14}$ and $R_{16}$) are first pixel electrodes, and green pixel electrodes (e.g., $G_{21}$, $G_{22}$, $G_{24}$ and $G_{25}$) are second pixel electrodes. In an exemplary embodiment, pixel voltages of the first pixel electrodes are reduced by a second kickback voltage generated as a result of a second kickback. When the red pixel electrodes (e.g., $R_{11}$, $R_{13}$, $R_{14}$ and $R_{16}$) which display a same color, e.g., red in this case, are consistently arranged to be the first pixel electrodes, the second kickback occurs only in the red pixel electrodes, thereby substantially reducing vertical stains in the display apparatus according to an exemplary embodiment.

Blue pixel electrodes (e.g., $B_{12}$, $B_{23}$, $B_{15}$ and $B_{26}$) can be either the first pixel electrodes or, alternatively, the second pixel electrodes. In this case, since the blue pixel electrodes are a combination of the first and second pixel electrodes, e.g., are included in both the first and second pixel electrodes, they may be seen on the display apparatus as vertical stains.

Therefore, as shown in FIG. 6, a distance d between a blue pixel electrode, e.g., the $B_{12}$ pixel electrode, for example, which in an exemplary embodiment is the first pixel electrode, and the second gate line GL2 is increased (relative to distances between other pixel electrodes and gate lines) to substantially reduce a drop in the pixel voltage of the $B_{12}$ pixel electrode due to the second kickback voltage. More specifically, for example, a vertical length (e.g., a height) of the $B_{12}$ pixel electrode, which is the first pixel electrode, is reduced to increase the distance d between the $B_{12}$ pixel electrode and the second gate line GL2, as shown in FIG. 6.

Likewise, a vertical length of the $B_{15}$ pixel electrode connected to the third gate line GL3 may be reduced to increase the distance d between the $B_{15}$ pixel electrode, which is also the first pixel electrode, and the fourth gate line GL4.

When the distances d between the second and fourth gate lines GL2 and GL4 and the $B_{12}$ and $B_{15}$ pixel electrodes, which are the first pixel electrodes and connected to the first gate line GL1 and the third gate line GL3, respectively, are increased as described above, voltage drops of the $B_{12}$ and $B_{15}$ pixel electrodes due to the second kickback voltage generated as a result of the second kickback are substantially reduced. A value of capacitance is also reduced by increasing the distance d, since the amount of accumulated electric charge is reduced with increasing distance. Thus, even though gate voltages from the second gate line GL2 and the fourth gate line GL4 are applied to the $B_{12}$ and $B_{15}$ pixel electrodes, respectively, which are the first pixel electrodes, the effect of the second kickback voltage on the $B_{12}$ and $B_{15}$ pixel electrodes by the second gate line GL2 and the fourth gate line GL4 is substantially reduced due to the increased distances d between the $B_{12}$ and $B_{15}$ pixel electrodes and the second gate line GL2 and the fourth gate line GL4, respectively.

Since the effect of the second kickback voltage on the $B_{12}$ and $B_{15}$ pixel electrodes, which are the first pixel electrodes and connected to the first gate line GL1 and the third gate line GL3, is substantially reduced, vertical stains caused by the $B_{12}$ and $B_{15}$ pixel electrodes in which the second kickback occurs are substantially reduced.

In addition, a distance d' between each of the blue pixel electrodes (e.g., $B_{12}$, $B_{23}$, $B_{15}$ and $B_{26}$) and a corresponding one of the first through fourth gate lines GL1 through GL4, respectively, which apply gate voltages to the blue pixel electrodes may be increased. More specifically, the distance d' between the first gate line GL1 and the $B_{12}$ pixel electrode, connected to the first gate line GL1, for example, may be increased to be greater than a distance between the first gate line GL1 and pixel electrodes which display other colors such as red and/or green. Likewise, the distance d' between the second gate line GL2 and the $B_{23}$ pixel electrode connected to the second gate line GL2 may be increased to be greater than the distance between the second gate line GL2 and pixel electrodes which represent other colors. Also, the distance d' between the third gate line GL3 and the $B_{15}$ pixel electrode connected to the third gate line GL3 and the distance between the fourth gate line GL4 and the $B_{26}$ pixel electrode connected to the fourth gate line GL4 may be increased to be greater than the distances between the third and fourth gate lines GL3 and GL4 and pixel electrodes which represent other colors. To increase the distance d' between each gate line and a corresponding blue pixel electrode, the blue pixel electrode may be moved in a vertical direction or, alternatively, a vertical length of the blue pixel electrode may be reduced.

When the distance d' between each gate line and a corresponding one of the B pixel electrodes (e.g., $B_{12}$, $B_{23}$, $B_{15}$ and $B_{26}$) is increased, capacitance between each gate line and corresponding blue pixel electrode is substantially reduced, thereby substantially reducing a kickback-induced drop in a pixel voltage of the corresponding blue pixel electrode. Consequently, the formation of the vertical stains in the blue pixel electrodes is substantially reduced.

Figure 7:
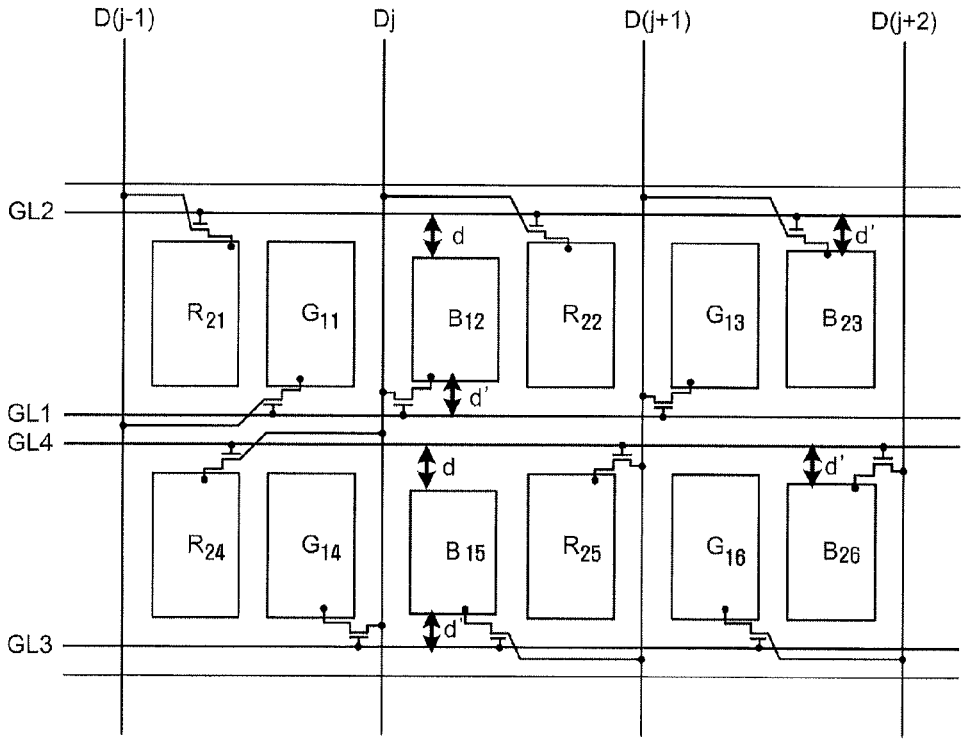
FIG. 7 is a plan view illustrating an arrangement of pixel electrodes in yet another exemplary embodiment of a display apparatus according to the present invention.

FIG. 7 is a plan view illustrating an arrangement of pixel electrodes in yet another alternative exemplary embodiment of a display apparatus according to the present invention.

Referring to FIG. 7, similar to as described above in greater detail with reference to FIG. 5, six pixel blocks arranged in a 2×3 matrix are disposed in display apparatus according to an exemplary embodiment. Thus, $G_{21}$, $R_{11}$; $B_{12}$, $G_{22}$; $R_{13}$, $B_{23}$; $G_{24}$, $R_{14}$; $B_{15}$, $G_{25}$; and $R_{16}$, $B_{26}$ groups of pixel electrodes may be arranged sequentially in the above-listed order in the six pixel blocks which are arranged in two rows, as shown in FIG. 7.

As in an exemplary embodiment described in greater detail above with reference to FIG. 6, vertical lengths of the $B_{12}$ and $B_{15}$ pixel electrodes, which are first pixel electrodes of the blue pixel electrodes (e.g., $B_{12}$, $B_{23}$, $B_{15}$ and $B_{26}$), may be reduced to increase the distances d between the $B_{12}$ and $B_{15}$ pixel electrodes and second and fourth gate lines GL2 and GL4, respectively. By increasing the distances d between the second and fourth gate lines GL2 and GL4, respectively, and the $B_{12}$ and $B_{15}$ pixel electrodes, which are connected to a first gate line GL1 and a third gate line GL3, respectively, to be greater than distances between the second and fourth gate lines GL2 and GL4, respectively, and pixel electrodes which represent other colors, a drop in a pixel voltage of each of the $B_{12}$ and $B_{15}$ pixel electrodes due to a second kickback voltage is substantially reduced. Therefore, formation of vertical stains in the blue pixel electrodes is substantially reduced.

Also, the distance d' between each of the blue pixel electrodes (e.g., $B_{12}$, $B_{23}$, $B_{15}$ and $B_{26}$) and a corresponding first through fourth gate lines GL1 through GL4, respectively, which apply gate voltages to the blue pixel electrodes may be increased. Thus, capacitance between each gate line and a corresponding blue pixel electrode is reduced, thereby substantially reducing a drop in the pixel voltage of the corresponding blue pixel electrode. Consequently, the formation of vertical stains in the blue pixel electrodes is substantially reduced.

Thus, in an exemplary embodiment, when pixel electrodes which represent a same color (e.g., red or green) are disposed as either the first pixel electrodes or the second pixel electrodes, formation of vertical stains due to the pixel electrodes is substantially reduced and/or is effectively eliminated. In addition, when a distance between each gate line and a corresponding blue pixel electrode (e.g., $B_{12}$, $B_{23}$, $B_{15}$ and $B_{26}$) is increased, formation of vertical stains in the blue pixel electrodes is substantially reduced and/or effectively minimized.

The present invention should not be construed as being limited to the exemplary embodiments set forth herein. Rather, these exemplary embodiments are provided so that this disclosure will be thorough and complete and will fully convey the concept of the present invention to those skilled in the art. In addition, the exemplary embodiments described herein will be considered in a descriptive sense only, and not for purposes of limitation.

For example, in an alternative exemplary embodiment, a method of driving a display apparatus includes: providing a plurality of pixel blocks, pixel blocks of the plurality of pixel blocks arranged in a matrix and each of the pixel blocks comprising a first pixel electrode connected to a first switching element and a second pixel electrode connected to a second pixel element; providing a first gate line disposed above the pixel blocks and a second gate line disposed below the pixel blocks, the first gate line and the second gate line extending along a row direction of the matrix, the first pixel electrode of each of the pixel blocks being connected to the first gate line and the second pixel electrode of each of the pixel blocks being connected to the second gate line; providing data lines which extend in a column direction of the matrix to intersect the first gate line and the second gate line; applying a gate voltage to the first gate line before applying the gate voltage to the second gate line; displaying a red color or a blue color with the first pixel electrode of each of the pixel blocks displays when the second pixel electrode of each of the pixel blocks displays a green color or the blue color; and displaying the green color or the blue color with the first pixel electrode of each of the pixel blocks displays when the second pixel electrode of each of the pixel blocks displays the red color or the blue color.

While the present invention has been particularly shown and described herein with reference to exemplary embodiments thereof, it will be understood by those of ordinary skill in the art that various changes in form and detail may be made therein without departing from the spirit or scope of the present invention as defined by the following claims.

What is claimed is:

1. A display apparatus comprising:

a first pixel block comprising a first pixel electrode connected to a first switching element and a second pixel electrode connected to a second switching element;

a second pixel block comprising a third pixel electrode connected to a third switching element and a fourth pixel electrode connected to a fourth switching element, the second pixel block being adjacent to the first pixel block in a first direction;

a third pixel block comprising a fifth pixel electrode connected to a fifth switching element and a sixth pixel electrode connected to a sixth switching element, the third pixel block being adjacent to the second pixel block in the first direction;

a first gate line extended in the first direction and connected to the first switching element, the fourth switching element, and the sixth switching element;

a second gate line extended in the first direction and connected to the second switching element, the third switching element, and the fifth switching element;

a first data line extended in a second direction crossing the first direction and connected to the first switching element and the second switching element;

a second data line extended in the second direction and connected to the third switching element and the fourth switching element; and a third data line extended in the second direction and connected to the fifth switching element and the sixth switching element, wherein a distance between the first switching element and the first data line is shorter than a distance between the second switching element and the first data line, wherein a distance between the third switching element and the second data line is shorter than a distance between the fourth switching element and the second data line, and wherein a distance between the fifth switching element and the third data line is shorter than a distance between the sixth switching element and the third data line.

2. The display apparatus of claim 1, wherein the first data line, the second data line, the third data line and the fourth data line are sequentially disposed in the first direction, and wherein the first pixel electrode, the second pixel electrode, the third pixel electrode, the fourth pixel electrode, the fifth pixel electrode and the sixth pixel electrode are sequentially disposed in the first direction.

3. The display apparatus of claim 2, wherein the first pixel block, the second pixel block, and the third pixel block are disposed between the first gate line and the second gate line.

4. The display apparatus of claim 2, further comprising:

a fourth pixel block comprising a seventh pixel electrode connected to a seventh switching element and an eighth pixel electrode connected to an eighth switching element, the fourth pixel block being adjacent to the first pixel block in the second direction;

a fifth pixel block comprising a ninth pixel electrode connected to a ninth switching element and a tenth pixel electrode connected to a tenth switching element, the fifth pixel block being adjacent to the fourth pixel block in the first direction and being adjacent to the second pixel block in the second direction, a sixth pixel block comprising a eleventh pixel electrode connected to a eleventh switching element and a twelfth pixel electrode connected to a twelfth switching element, the sixth pixel block being adjacent to the fifth pixel block in the first direction and being adjacent to the third pixel block in the second direction a third gate line extended in the first direction and being adjacent to the second gate line in the second direction, a fourth gate line extended in the first direction and being adjacent to the fourth pixel block in the second direction a fourth data line extended in the second direction and being adjacent to the third data line in the first direction wherein the seventh switching element is connected to the third gate line and the second data line, wherein the eighth switching element is connected to the fourth gate line and the second data line, wherein the ninth switching element is connected to the fourth gate line and the third data line, wherein the tenth switching element is connected to the third gate line and the third data line, wherein the eleventh switching element is connected to the fourth gate line and the fourth data line, wherein the twelfth switching element is connected to the third gate line and the fourth data line, wherein a distance between the seventh switching element and the second data line is longer than a distance between the eighth switching element and the second data line, wherein a distance between the ninth switching element and the third data line is longer than a distance between the tenth switching element and the third data line, and wherein a distance between the eleventh switching element and the fourth data line is longer than a distance between the twelfth switching element and the fourth data line.

5. The display apparatus of claim 4, wherein the seventh pixel electrode, the eighth pixel electrode, the ninth pixel electrode, the tenth pixel electrode, the eleventh pixel electrode and the twelfth pixel electrode are sequentially disposed in the first direction, and wherein the second gate line and the third gate line are disposed between the first pixel block and the fourth pixel block.

6. The display apparatus of claim 5, wherein the fourth pixel block, the fifth pixel block, and the sixth pixel block are disposed between the third gate line and the fourth gate line.

7. A display apparatus comprising:

a first pixel row comprising a first pixel electrode connected to a first switching element, a second pixel electrode connected to a second switching element, and a third pixel electrode connected to a third switching element;

a second pixel row comprising a fourth pixel electrode connected to a fourth switching element a fifth pixel electrode connected to a fifth switching element, and a sixth pixel electrode connected to a sixth switching element, the second pixel row being adjacent to the first pixel row in a second direction;

a first gate line extended in the first direction and connected to the first switching element, the second switching element, and the third switching element;

a second gate line extended in the first direction and connected to the fourth switching element, the fifth switching element, and the sixth switching element;

a first data line extended in the second direction and connected to the first switching element;

a second data line extended in the second direction, connected to the second switching element and the fourth switching element, and disposed between the first pixel electrode and the second pixel electrode;

a third data line extended in the second direction, connected to the third switching element and the fifth switching element, and disposed between the second pixel electrode and the third pixel electrode; and a fourth data line extended in the second direction and connected to the sixth switching element;

wherein the first gate line and the second gate line are disposed between the first pixel row and the second pixel row, wherein the second data line is disposed between the fourth pixel electrode and the fifth pixel electrode, wherein the third data line is disposed between the fifth pixel electrode and the sixth pixel electrode, wherein a distance between the third data line and the second pixel electrode is longer than a distance between the third data line and the third pixel electrode, and wherein a distance between the third data line and the fifth pixel electrode is shorter than a distance between the third data line and the sixth pixel electrode.

8. The display apparatus of claim 7, wherein the distance between the third data line and the second pixel electrode is substantially same as the distance between the third data line and the sixth pixel electrode, and wherein the distance between the third data line and the third pixel electrode is substantially same as the distance between the third data line and the fifth pixel electrode.

9. The display apparatus of claim 7, wherein a distance between the second data line and the first pixel electrode is shorter than a distance between the second data line and the fourth pixel electrode, and wherein a distance between the second data line and the second pixel electrode is shorter than a distance between the second data line and the fifth pixel electrode.

10. The display apparatus of claim 9, wherein a distance between the second data line and the first pixel electrode is shorter than a distance between the second data line and the fourth pixel electrode, and wherein a distance between the second data line and the second pixel electrode is shorter than a distance between the second data line and the fifth pixel electrode.

11. The display apparatus of claim 7, wherein the second pixel electrode and the third pixel electrode are not symmetrically disposed with respect to the third data line, and wherein the fifth pixel electrode and the sixth pixel electrode are not symmetrically disposed with respect to the third data line.

12. The display apparatus of claim 7, further comprising:

a first pixel column comprising the fourth pixel electrode;

a second pixel column comprising the first pixel electrode;

a third pixel column comprising the second pixel electrode;

a fourth pixel column comprising the fifth pixel electrode;

a fifth pixel column comprising the third pixel electrode; and a sixth pixel column comprising the sixth pixel electrode;

wherein the first pixel column, the second pixel column, the third pixel column, the fourth pixel column, the fifth pixel column, and the sixth pixel column are sequentially disposed in the first direction, and wherein the first pixel column and the second pixel column are disposed between the first data line and the second data line wherein the third pixel column and the fourth pixel column are disposed between the second data line and the third data line, and wherein the fifth pixel column and the sixth pixel column are disposed between the third data line and the fourth data line.

* * * * *